US008191186B2

(12) United States Patent
Lobry

(10) Patent No.: US 8,191,186 B2
(45) Date of Patent: Jun. 5, 2012

(54) DEVICE FOR THE SUSPENSION OF SLATS FOR A BED

(75) Inventor: Pascal Lobry, Bourges (FR)

(73) Assignee: Tournadre SA Standard Gum, Bourges (FR)

( * ) Notice: Subject to any disclaimer, the term of this patent is extended or adjusted under 35 U.S.C. 154(b) by 300 days.

(21) Appl. No.: 11/919,328

(22) PCT Filed: Apr. 27, 2006

(86) PCT No.: PCT/FR2006/050396

§ 371 (c)(1),
(2), (4) Date: Oct. 26, 2007

(87) PCT Pub. No.: WO2006/114554

PCT Pub. Date: Nov. 2, 2006

(65) Prior Publication Data

US 2009/0288252 A1 Nov. 26, 2009

(30) Foreign Application Priority Data

Apr. 27, 2005 (FR) ..... 05 04260

(51) Int. Cl.
*A47C 23/06* (2006.01)

(52) U.S. Cl. ..... 5/238; 5/236.1; 5/237

(58) Field of Classification Search ..... 5/236.1, 5/238, 237, 242, 244, 241
See application file for complete search history.

(56) References Cited

U.S. PATENT DOCUMENTS

| | | | | | |
|---|---|---|---|---|---|
| 210,145 | A | * | 11/1878 | Pettit | 5/237 |
| 3,067,438 | A | * | 12/1962 | Degen | 5/237 |
| 3,605,142 | A | * | 9/1971 | Weinhart | 5/238 |
| 4,644,596 | A | * | 2/1987 | Husler | 5/236.1 |
| 4,935,977 | A | * | 6/1990 | Yamada | 5/237 |
| 5,369,826 | A | * | 12/1994 | Ikeda | 5/613 |
| 5,469,591 | A | * | 11/1995 | Nomura | 5/236.1 |
| 5,774,911 | A | * | 7/1998 | Stube et al. | 5/238 |
| 5,924,149 | A | * | 7/1999 | Weber | 5/238 |
| 5,926,872 | A | * | 7/1999 | Rossdeutscher | 5/236.1 |
| 6,073,281 | A | * | 6/2000 | Huber | 5/238 |
| 6,701,550 | B2 | * | 3/2004 | Baeriswyl | 5/236.1 |
| 6,718,575 | B1 | * | 4/2004 | Lubeck et al. | 5/236.1 |
| 6,877,174 | B2 | * | 4/2005 | Lobry | 5/238 |
| 7,069,606 | B2 | * | 7/2006 | Verschuere et al. | 5/238 |
| 2005/0258205 | A1 | * | 11/2005 | French | 224/264 |

FOREIGN PATENT DOCUMENTS

| | | | |
|---|---|---|---|
| DE | 87 08 934 | U | 1/1988 |
| DE | 90 04 207 | U | 1/1991 |
| EP | 0 641 534 | A | 3/1995 |
| EP | 1 114 597 | A | 7/2001 |

* cited by examiner

*Primary Examiner* — Robert G Santos
*Assistant Examiner* — Brittany Wilson
(74) *Attorney, Agent, or Firm* — Kenyon & Kenyon LLP

(57) ABSTRACT

The invention concerns a bed base slat suspension device comprising at least one gusset forming a housing for accommodating the end of a bed base slat, said device having fixing means for allowing the fixing of the gusset on a bed base frame. The device comprises a plurality of n gussets connected by means forming a connecting band, arranged so as to allow a relative movement of at least certain adjacent gussets from the point of view of the fixing of the device on the bed base frame.

22 Claims, 6 Drawing Sheets

DEVICE FOR THE SUSPENSION OF SLATS FOR A BED

This is a 371 national phase application of PCT/FR2006/050396 filed 27 Apr. 2006, claiming priority to French Patent Application No. FR 0504260 filed 27 Apr. 2005, the contents of which are incorporated herein by reference.

The invention concerns a bed base slat suspension device comprising at least one gusset forming a housing for accommodating the end of a bed base slat, said device having fixing means for allowing the fixing of the gusset on a bed base frame.

Such devices making it possible to hold one or more slats to form the bed base of a bed are known. In general, these devices form a fixing block for one or two slats fixed to the bed base by fixings such as anchorages.

However, in order to be installed on bed bases, such devices require drilling of the latter by manufacturers equipped with special drilling or fixing machines, in order to ensure correct positioning of the elements with respect to one another and obtain alignment of the slats. In particular, it is preferable to carry out correct positioning of the fixings of each block on the bed base frame in order to then be able to install the slats substantially parallel with respect to one another.

The aim of the present invention is to provide a device that makes it possible to provide quick mounting by the customer, or provide faster pre-mounting in the factory.

This aim of the invention is achieved by the fact that the device comprises a plurality of n gussets connected by means forming a connecting band, arranged so as to allow a relative movement of at least certain adjacent gussets from the point of view of the fixing of the device on the bed base frame.

The assembly of the gussets and the means forming a connecting band forms a whole that can be easily handled and mounted.

Consequently, pre-mounting in the factory can be carried out more quickly. Furthermore, customers, even if they are not accustomed to this type of mounting, can themselves carry out a quick installation of the device.

Moreover, the fact that the gussets are arranged so as to allow a relative movement of certain of them makes it possible to compensate for any mounting faults and modify the spacing between the slats, for example in order to provide more slats in the part of the bed base corresponding to the back than in that corresponding to the feet. Furthermore, this also makes it possible to provide the play necessary to allow the movement of one gusset with respect to another, in particular for beds having bed bases whereof the head and/or feet can be raised.

Preferentially, the connecting means comprise a connecting section between two adjacent gussets and at least one of the connecting sections has at least one undulation.

Preferentially, the connecting sections are similar and have one or more undulations. Moreover, the latter are preferentially of similar shape and amplitude.

By virtue of the deformability of the connecting section, in particular by elastic deformation, mobility of a gusset with respect to the gusset directly adjacent to it is permitted and enables accommodation of any faults which are generally due to incorrect positioning of the gussets with respect to one another, during mounting of the device on the bed base.

Users thus find comfort similar to that they would have obtained with separate blocks mounted in the factory.

The connecting section is preferentially wavy. The waves can be in the form of undulations or concertina folds, which preferentially extend between two adjacent gussets, either in a plane parallel to that comprising the slats inserted in the gussets, or in a plane perpendicular thereto.

In order to optimise the mounting time, the number of gussets n is preferentially chosen so that the device allows equipping of an entire standard length of a bed, in particular for a length equal to 1.90 m, 2 m or more. If the assembly is longer than the bed base frame, all that is needed is to cut the band to the correct length using only the number of gussets necessary.

Thus, provision can be made to provide a mounting kit comprising two devices intended to equip the two longitudinal sides of a bed base. Subassemblies can also be provided whereof the number will be chosen according to the length of the bed; however, it will be understood that the mounting of such subassemblies requires more mounting time.

The fixing means are preferentially chosen from amongst "pine-tail" anchorages (in which case, the bed base frame can be pre-drilled, pre-grooved or pre-machined, or, on the contrary, be drilled during installation of the device), riveting, tacking and clipping in or on a shaped section previously fixed on the bed base frame.

The invention will be better understood and its advantages will emerge more clearly from a reading of the following detailed description of embodiments of the invention depicted by way of non-limiting examples.

The description refers to the accompanying drawings in which.

Figure 1:
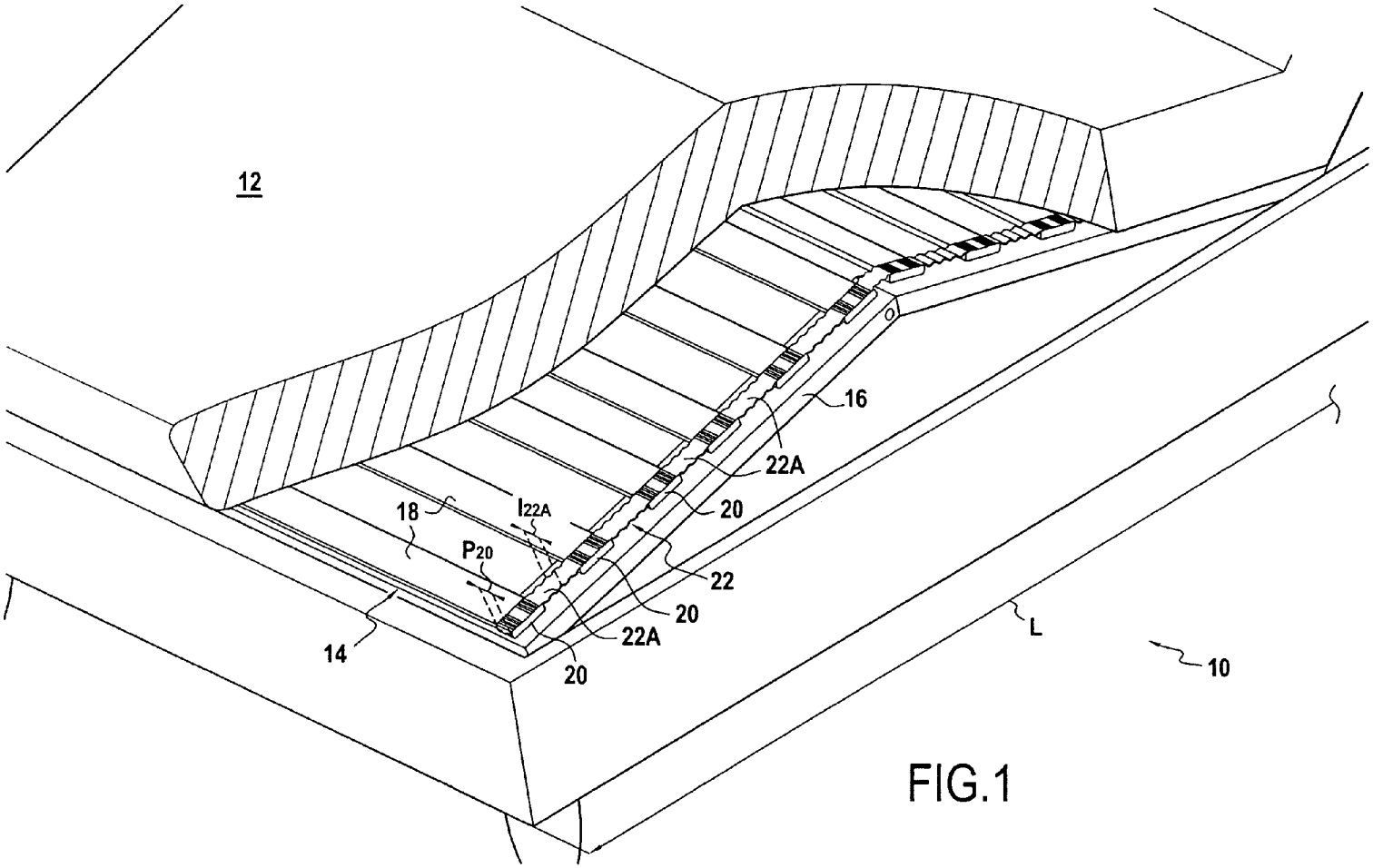
FIG. 1 depicts a perspective view of a bed equipped with a device according to the invention.

FIG. 1 depicts a bed 10 equipped with a mattress 12 that rests on a slatted bed base 14 fixed on a bed frame 16. The slatted bed base 14 comprises a plurality n of slats 18.

Each slat end 16 is fixed in a gusset 20 forming a housing and the set of n gussets 20 is connected by means forming a connecting band 22. Thus, the gussets 20 are connected to one another to form a device according to the invention.

In fact the gussets 20 are connected successively so as to form a chain of n gussets with a length corresponding either to the standard length of a bed base, that is to say preferentially of lengths L equal to 1.90 m or 2 m and over, or to a multiple or sub-multiple of such a length L. The chain can in particular have a length equal to a multiple of two with respect to the length of the bed base frame, so that the user has only to cut it in two to be able to completely equip a bed.

Figure 2A:
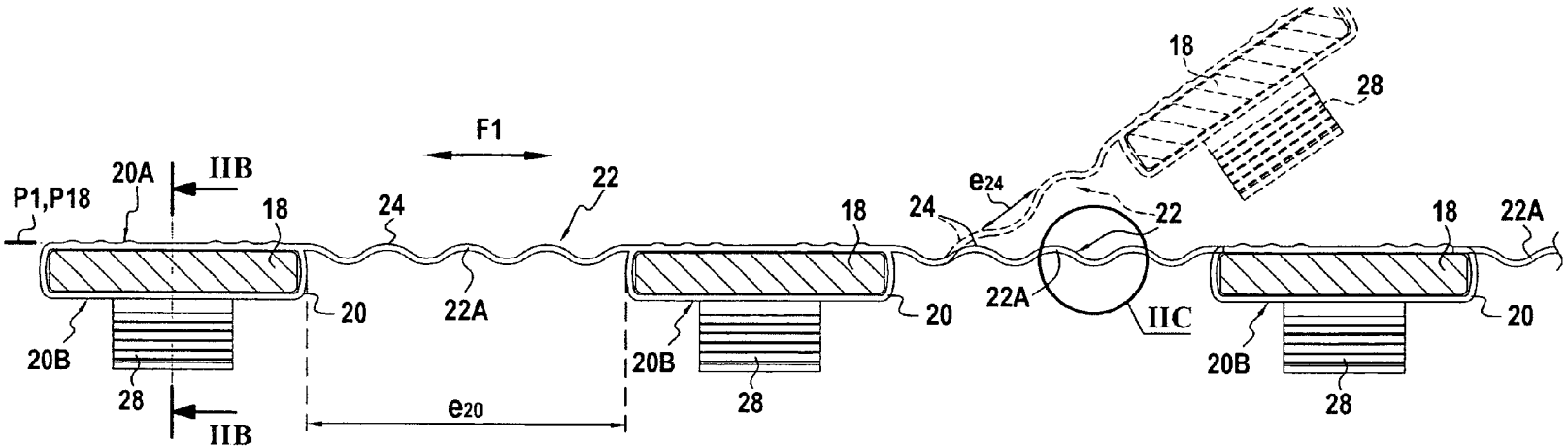
FIG. 2A depicts a side view of the device of FIG. 1 without the bed.

FIG. 2A shows, in a side view, part of the device illustrated in FIG. 1.

Means forming a connecting band 22 connect the gussets 20 by their upper part 20A. The means forming a connecting band 22 comprise a connecting section 22A between each pair of two adjacent gussets 18, which is preferentially in the form of a band, whereof the width 122A is substantially equal to the depth $P_{20}$ of a gusset 20; $P_{20}$ corresponding substantially to the depth of the housing formed in the gusset 20 for accommodating a slat end (apart from the thickness of the gusset walls).

At least one of the connecting sections 22A has at least one undulation 24. In the case in point, as illustrated in FIG. 2A, each connecting section 22A has a plurality of undulations 24 which have a greater or lesser amplitude, and which make it possible to obtain fixings at a variable distance and avoid areas with no support which fold, in particular in the case of beds with bed bases whereof the head and/or feet can be raised.

In fact, it will be understood that, on the one hand, these connecting sections 22A make it possible to accommodate any mounting faults of the gussets 20 and, on the other hand, enable a relative movement of at least certain adjacent gussets 20, from the point of view of the fixing of the device on the bed base frame 16.

Relative movement between two gussets may, for example, be necessary in a plane $P_1$ parallel to that $P_{18}$ comprising the slats 18, in particular during mounting of the device and fixing of the gussets to the slatted bed base 16. In this case, the connecting sections 22A stretch preferentially in a direction indicated by the arrow F1 illustrated in FIG. 2A, so that the spacing e20 can be adjusted according to any differences between the drilling distances in the bed base frame 16 and allow fixing of the device thereon.

Figure 2C:
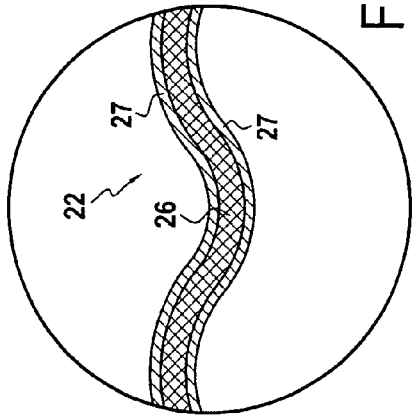
FIG. 2C depicts an enlargement IIC of part of the device of FIG. 2A.
Figure 2B:
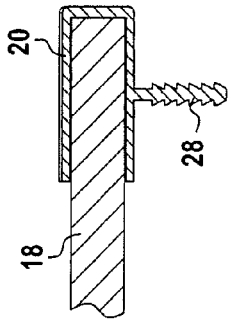
FIG. 2B depicts a partial section of the device of FIG. 2A along the line IIB-IIB.

The fixing means illustrated in FIGS. 2A and 2B comprise "pine-tail" anchorages 28 intended to be inserted in holes (not illustrated) provided for that purpose in the bed base frame 16, in particular in the long sides of the bed base frame. In the case in point, each gusset 20 has in the lower part 20B a "pine-tail" anchorage 28. It will be understood that the deformability of the undulations makes it possible to accommodate faults in the spacing of these holes, in particular when the spacing between these holes does not correspond exactly to the spacing between the "pine-tail" anchorages 28.

Furthermore, relative movement between two adjacent gussets 20 can also take place by an increase in the spacing e24 of the undulations 24, in particular to allow raising of the bed base at the head and/or feet, as illustrated schematically in dotted lines in FIG. 2A. In fact, FIG. 2A shows in solid lines the device in the rest position, in which the undulations 24 have an average amplitude, and can either be stretched out or moved closer together.

As soon as the user wishes to raise the head and/or feet, it is necessary for the gussets to be able to move with respect to one another, in particular in the vicinity of the inclination axis. In fact, it will be understood that, according to the inclination sought, it must be possible to modify the spacing between two adjacent slats 18 situated either side of this inclination axis, that is to say between two fixing points of the corresponding gussets 20.

Such movements between the gussets 20, i.e. stretching of the connecting sections 22A and/or increase in the spacing of the undulations 24, are possible provided that the connecting sections 22A are capable of deforming, preferably elastically.

In order to allow such a deformation, the means forming a connecting band 22, in the case in point the connecting sections 22A, comprise a material chosen from amongst the polymers, textiles and/or metals.

It will be understood that the connecting sections 22A have a greater or lesser flexibility, allowing a relative movement of adjacent gussets with respect to one another, according to the nature of the material or materials chosen and according to the number and amplitude of the undulations 24 formed on the connecting bands 22A. Thus, according to the bed base quality sought, the connecting sections of the device according to the invention will be flexible to a greater or lesser degree.

Furthermore, the choice of materials, and the shape and number of the undulations, will allow the aforementioned different types of movement between two adjacent gussets 20.

Thus, the means forming a connecting band preferentially comprise a woven strip 26 as illustrated in FIG. 2C, preferably made of textile, possibly overmoulded with a polymer material having an ad hoc elasticity. It will be understood that, without being overmoulded, the woven strip 26 enables a relative movement between certain of the gussets, but would not be able to retain the undulations 24. In fact, the overmoulded part 27 covering the woven strip 26 makes it possible to strengthen the latter and keep the undulations 24, whilst allowing the extension or retraction of the connecting sections 22A.

Figure 3A:
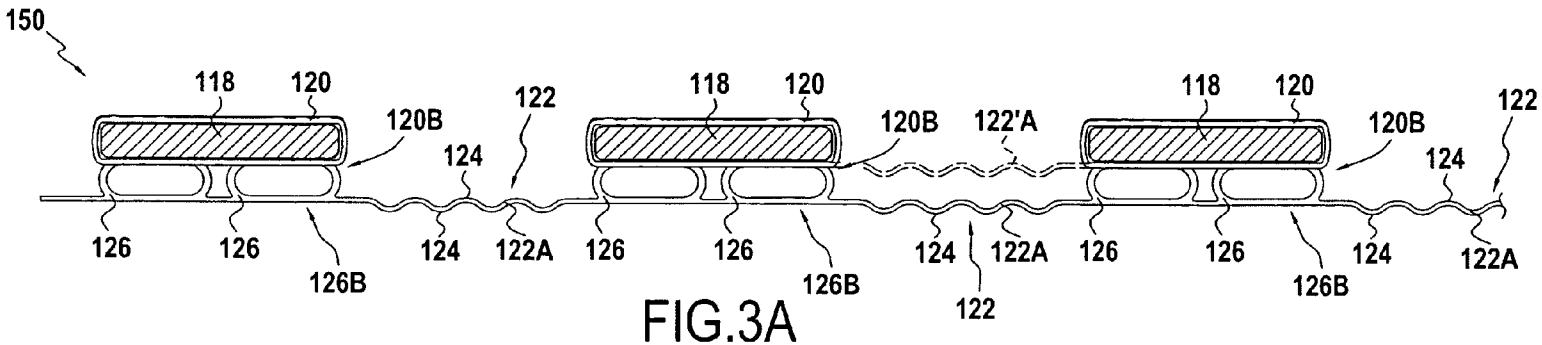
FIG. 3A depicts a side view of a device according to a variant.
Figure 3B:
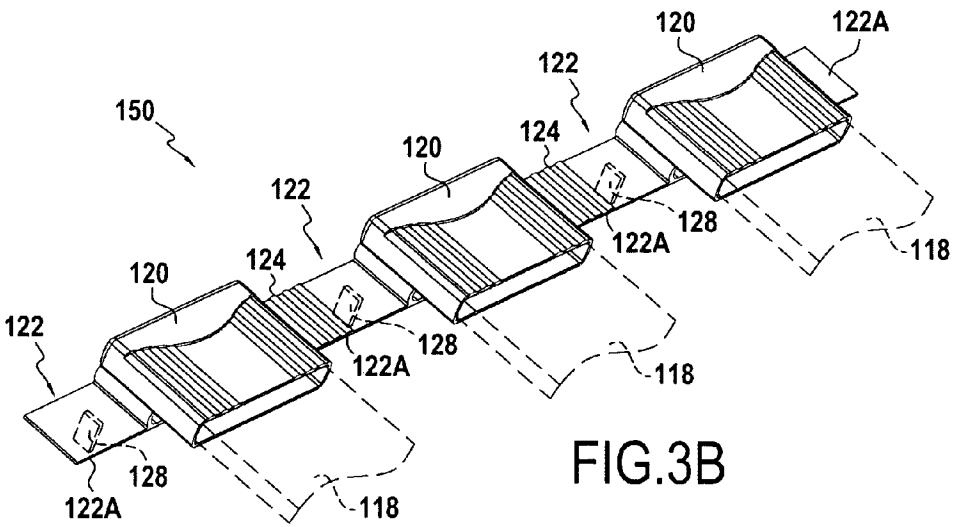
FIG. 3B depicts a perspective view of the device of FIG. 3A.

According to a variant of the invention, illustrated in FIGS. 3A and 3B, the means forming a connecting band 122 connect the gussets 120 by their lower part 120B.

In the case in point, each gusset 120 is connected, in the lower part, to elastic suspension means 126 and the means forming a connecting band 122 are preferentially formed in the lower part of the gussets 120B, so as to connect the elastic suspension means.

Thus, it will be understood that, in the absence of such elastic suspension means 126, the means forming a connecting band 122 directly connect the gussets 120 by their lower part 120B, whilst in the presence of elastic suspension means 126, the means forming a connecting band 122 indirectly connect the gussets 120 by their lower part 120B. Of course, the means forming a connecting band 122 could connect the gussets 120 in other regions, for example in an intermediate part as indicated at 122'A by dotted lines.

Such elastic suspension means 126 are known for enabling a movement of the slats with respect to one another and allowing greater comfort for the user.

The fact that the means forming a connecting band 122 connect the elastic suspension means 126 in the lower part 126B facilitates their correct positioning with respect to the bed base, without harming the suspension.

As for the variant described previously, the means forming a connecting band 122 have a connecting section 122A between two adjacent gussets 120, in the case in point between the elastic suspension means 126 of two adjacent gussets 120, each connecting section 122A having at least one undulation 124.

The device according to the invention, and in particular the variant illustrated in FIGS. 3A and 3B, is moulded in a single piece 150.

Thus, the material forming the gussets 120, and preferentially the elastic suspension means 126, is preferentially the same as that composing the means forming a connecting band 122.

The means forming a connecting band 122 make it possible, in particular, to fix the device using fixing means, such as riveting (not illustrated) or tacking 128. In the latter case, the anchorage is carried out preferentially between two adjacent gussets, either in an area of the means forming a connecting band 122 which has no undulations, as illustrated in FIG. 3B, or by flattening an undulation.

Figure 4A:
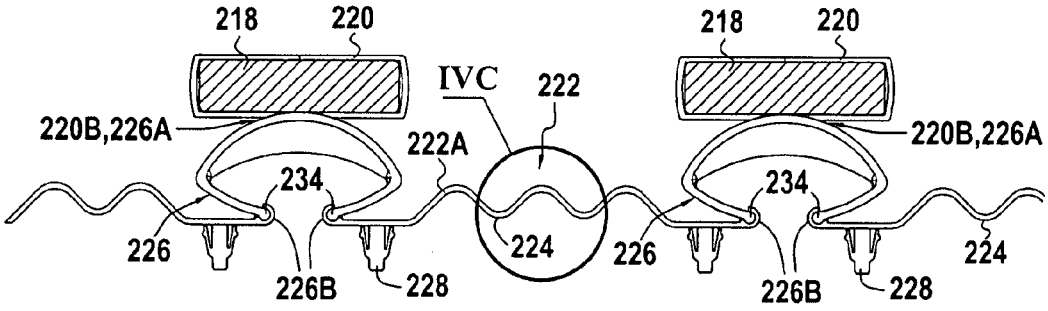
FIG. 4A depicts a side view of a device according to another variant.
Figure 4B:
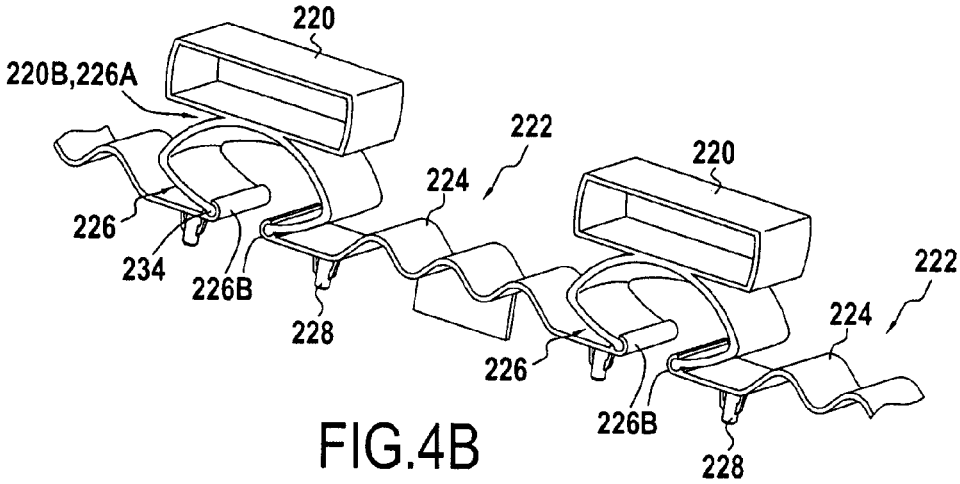
FIG. 4B depicts a perspective view of the device of FIG. 4A.

The number of elastic suspension means can in particular be two per gusset, as illustrated in FIGS. 3A and 3B, or else be one per gusset, as illustrated in FIGS. 4A and 4B. Their shape and number and the material forming them are chosen by the manufacturer, according to the comfort sought. During renewal of their bed base, users will thus choose the device that suits them.

For each gusset 220, the elastic suspension means 226 depicted in FIGS. 4A and 4B is respectively connected by its upper part 226A to the lower part 220B of the corresponding gusset 220, whilst the suspension means 226 of two adjacent gussets 220 are connected to one another by their lower part 226B using the means forming a connecting band 222.

Figure 4C:
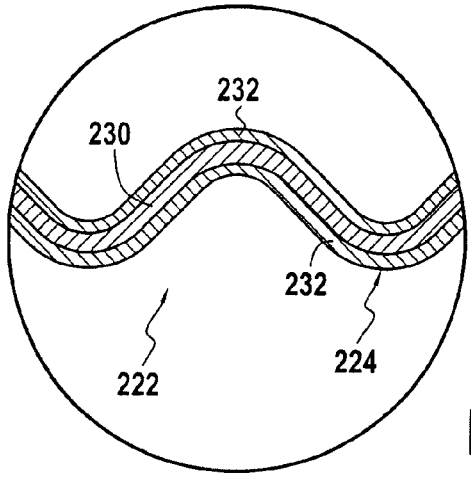
FIG. 4C depicts an enlargement IVC of part of the device of FIG. 4A.

The means forming a connecting band of the aforementioned variants, and in particular those of the variant illustrated in FIGS. 4A to 4C, can be made of one single-material piece or comprise a metal ribbon 230 having undulations 224. In the latter case, the means forming a connecting band 222 preferentially comprise a part 232 overmoulded on this metal ribbon 230, as illustrated in FIG. 4C.

The assembly formed by the metal ribbon 230 and the overmoulded part 232 makes it possible to obtain both the rigidity necessary for retaining the shape of the undulations 224 and the deformability required for allowing the deformation of the latter and thus enabling a relative movement of certain adjacent gussets 220. Preferentially, the deformation is elastic in order to allow the undulations 224 to return naturally to their position at rest depicted in the figures.

This assembly can be fixed to a bed base frame 16, using the aforementioned fixing means or by clipping 228 in or on a shaped section (not illustrated) fixed beforehand on the bed base frame. Depending on the shape of the suspension means 226, one or more clips per gusset can be provided. In the case in point, the device illustrated in FIGS. 4A and 4B has two clips 228 arranged either side of each gusset 220.

As described previously, the device can be moulded in a single piece; the means forming a connecting band can comprise a woven strip and/or a metal ribbon possibly overmoulded or else, as illustrated by way of example in FIGS. 4A and 4B, the gussets 220 can be clipped to the means forming a connecting band 222 using clips 234 of known type.

Figure 5A:
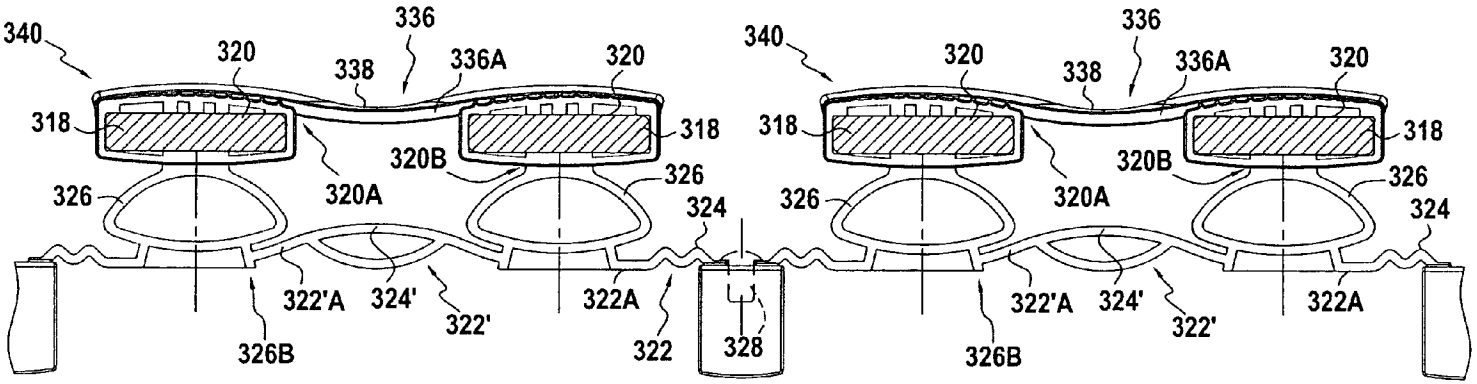
FIG. 5A depicts a side view of a device according to another variant.
Figure 5B:
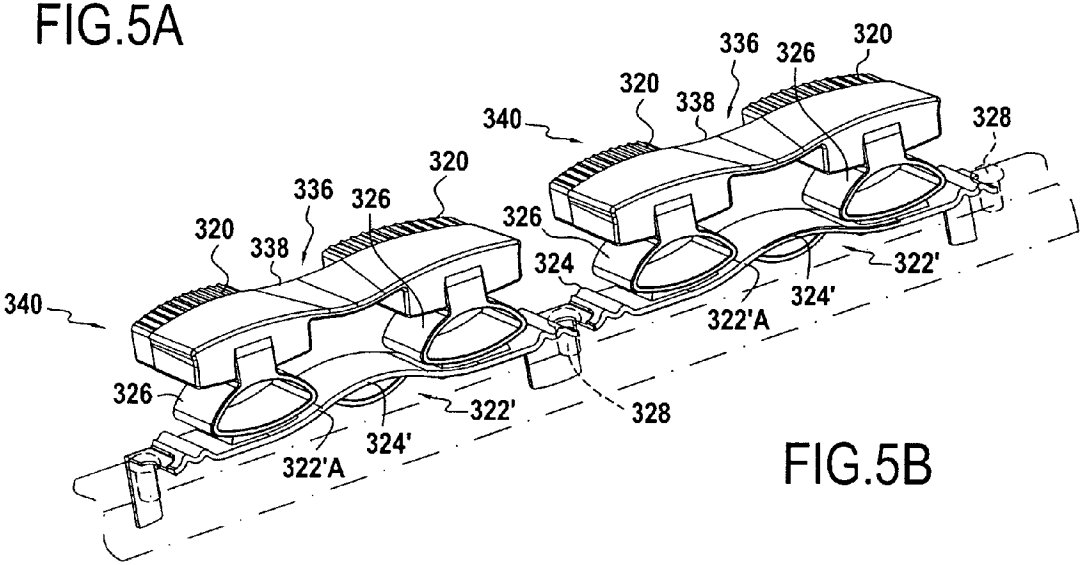
FIG. 5B depicts a perspective view of the device of FIG. 5A.

According to another variant illustrated in FIGS. 5A and 5B, in addition to the means forming a connecting band 322 which make it possible to connect all the gussets in a chain, the device comprises second means forming a connecting band 336 which make it possible to connect the gussets in groups of at least two gussets. In the case in point, connecting bridges 336 connect the gussets 320 in pairs, preferentially in the upper part 320A.

Thus, the gussets 320 are connected in the lower part 320B, using means forming a connecting band 322 as aforementioned, so as to form a chain. In the case in point, the device illustrated in FIGS. 5A and 5B comprising elastic suspension means 326, the gussets 320 are connected by the lower part 326B of the elastic suspension means 326, whilst they are connected in pairs in the upper part. This variant makes it possible in particular to equip the known bed bases of the dual-slat and triple-slat bed base type.

To that end, the connecting bridges 336 connecting the gussets 320 in pairs, adjacently, without for all that connecting all the gussets continuously, preferentially comprise a connecting section 336A that has at least one undulation 338.

In the lower part, the pairs 340 of gussets are connected by means forming a connecting band 322 described according to any one of the aforementioned variants comprising in particular connecting sections 322A that have at least one undulation 324.

Moreover, within a pair 340, the gussets 320 are connected to each other by means forming a connecting band 322' comprising preferentially a connecting section 322'A having at least one undulation 324'.

Such a device is preferentially fixed to the bed base frame in the vicinity of the means forming a connecting band 322 which make it possible to interconnect the pairs 340. The fixing means can be chosen from amongst "pine-tail" anchorages, tacking, clipping in or on a shaped section or, as illustrated in FIG. 5B, riveting 328. In the latter case, the anchorage is carried out preferentially between two adjacent gussets, in an area of the means forming a connecting band 322 which has no undulations, as illustrated in FIG. 5B, or by flattening an undulation.

Figure 6A:
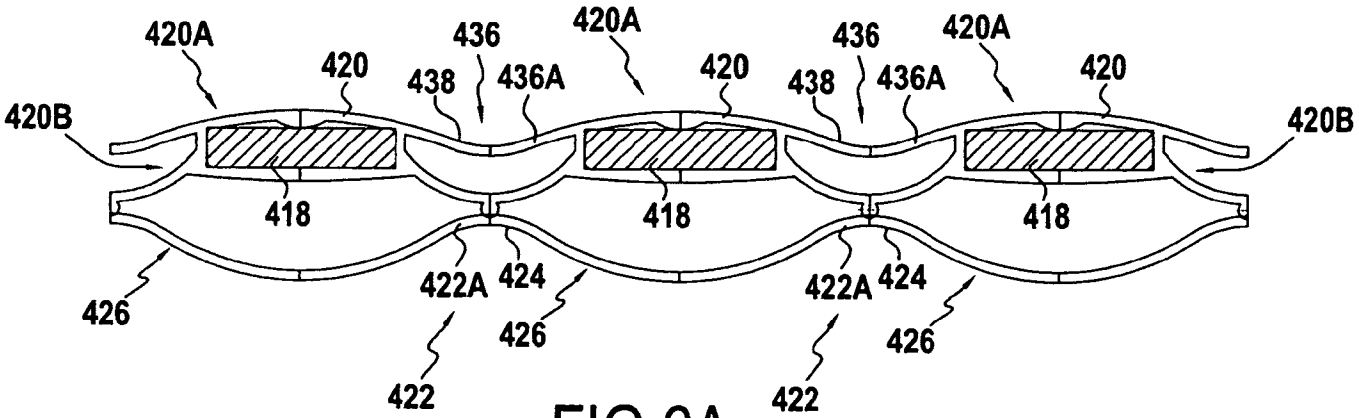
FIG. 6A depicts a side view of a device according to another variant.
Figure 6B:
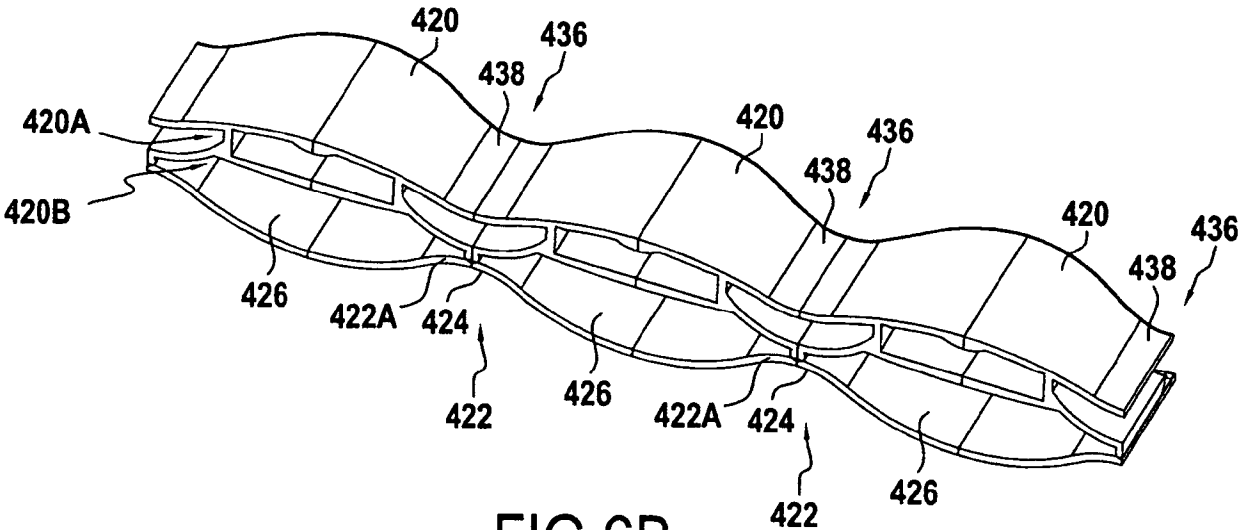
FIG. 6B depicts a perspective view of the device of FIG. 6B.

According to another variant illustrated in FIGS. 6A and 6B, the gussets 420 are connected to one another, in the lower part 420B, by means forming a connecting band 422. In the case in point, the device comprises, in the lower part 420B of the gussets 420, elastic suspension means 426 that are connected to one another by means of the means forming a connecting band 422. The means forming a connecting band 422 comprise a connecting section 422A that has at least one undulation 424 between two adjacent gussets 420.

The shape of the elastic suspension means 426 and the amplitude of the undulations 424 are chosen so that the elastic suspension means 426 and the means forming a connecting band 422 are connected continuously with no point between the two where the curve changes, that is to say the curvature of the undulations 424 preferentially follows that of the elastic suspension means 426, as illustrated in FIGS. 6A and 6B.

Moreover, the gussets 420 are connected to one another in the upper part 420A by second means forming a connecting band, in the case in point connecting bridges 436 that comprise a connecting section 436A that has at least one undulation 438.

Just as in the lower part, the shape and amplitude of the undulations 438 of these connecting bridges 436 are chosen so as to connect the gussets 420 continuously.

The device thus obtained is in the form of a wavy chain that extends in the form of a series of continuous undulations in the upper part and the lower part.

The fixing means allowing the device to be held on a bed base frame are of one of the aforementioned types.

The second means forming a connecting band 236 and 336 are of a similar kind and are obtained in a similar manner to the means forming a connecting band 20; 120; 220; 320; 420. In particular these second means forming a connecting band 236 and 336 can comprise a woven strip and/or a metal ribbon, possibly be overmoulded, moulded in a single piece with the device or be clipped to the gussets.

The invention claimed is:

1. A bed base slat suspension device comprising a plurality of gussets connected in a chain, each gusset forming a housing for accommodating the end of a bed base slat, said device having fixing means for fixing said device to a bed base frame, said fixing means being located in a lower part of each gusset, wherein at least two adjacent gussets are connected together by a deformable connecting section comprising a plurality of undulations so as to allow relative movement between the at least two adjacent gussets.

2. The device according to claim 1, wherein the number of gussets is chosen so that the device allows equipping of an entire length of a bed.

3. The device according to claim 1, wherein the fixing means are chosen from amongst "pine-tail" anchorages, riveting, tacking and clipping in a shaped section previously fixed on the bed base frame.

4. The device according to claim 1, wherein the device is moulded in a single piece.

5. The device according to claim 1, comprising a plurality of connecting sections forming a connecting band.

6. The device according to claim 5, wherein the means forming a connecting band connect the gussets by their upper part.

7. The device according to claim 5, wherein the connecting band comprises a woven strip.

8. The device according to claim 5, wherein the connecting band comprises an overmoulded part.

9. The device according to claim 5, wherein the connecting band comprises a material chosen from amongst the polymers, textiles and metals.

10. A base slat suspension device comprising a plurality of gussets connected in a chain, each gusset forming a housing for accommodating the end of a bed base slat, said device having fixing means for allowing the fixing of the gusset on a bed base frame, said gussets being connected by means forming a connecting band, arranged so as to allow a relative movement of at least certain adjacent gussets from the point of view of the fixing of the device on the bed base frame, wherein the device further comprises elastic suspension means connected to each other by the connecting band, wherein the connecting band comprises at least one undulation, and wherein the shape of the elastic suspension means and the amplitude of the undulation are chosen so that the elastic suspension means and the connecting band are connected continuously.

11. A bed base slat suspension device comprising a plurality of gussets connected in a chain, each gusset forming a housing for accommodating the end of a bed base slat, said device having fixing means for fixing said device to a bed base frame, wherein at least two adjacent gussets are connected together by a deformable connecting section comprising a plurality of undulations so as to allow relative movement between the at least two adjacent gussets, wherein the fixing means are disposed on the connecting section, wherein each gusset is connected, in the lower part, to elastic suspension means, and wherein the connecting section is formed in the lower part of the gussets, so as to connect the elastic suspension means.

12. The device according to claim 11, wherein the number of gussets is chosen so that the device allows equipping of an entire length of a bed.

13. The device according to claim 11, comprising a plurality of connecting sections forming a connecting band.

14. The device according to claim 13, wherein the means forming a connecting band connect the gussets by their lower part.

15. The device according to claim 14, further comprising second connecting means, in the upper part of the gussets, which make it possible to connect the gussets at least in pairs.

16. The device according to claim 13, wherein the connecting band comprises a metal ribbon.

17. The device according to claim 13, wherein the gussets are clipped to the connecting band.

18. The device according to claim 13, wherein the connecting band comprises a woven strip.

19. The device according to claim 13, wherein the connecting band comprises an overmoulded part.

20. The device according to claim 13, wherein the connecting band comprises a material chosen from amongst the polymers, textiles and metals.

21. The device according to claim 11, wherein the fixing means are chosen from amongst "pine-tail" anchorages, riveting, tacking and clipping in a shaped section previously fixed on the bed base frame.

22. The device according to claim 11, wherein the device is moulded in a single piece.

* * * * *